United States Patent [19]

Cheney et al.

[11] 3,974,245

[45] Aug. 10, 1976

[54] PROCESS FOR PRODUCING FREE FLOWING POWDER AND PRODUCT

[75] Inventors: Richard F. Cheney, Towanda; Charles L. Moscatello, Sayre; Frederick J. Mower, Towanda, all of Pa.

[73] Assignee: GTE Sylvania Incorporated, Stamford, Conn.

[22] Filed: Apr. 25, 1975

[21] Appl. No.: 571,642

Related U.S. Application Data

[62] Division of Ser. No. 425,226, Dec. 17, 1973, Pat. No. 3,909,241.

[52] U.S. Cl. ..... 264/10; 75/.5 B; 75/.5 BA; 75/.5 BB; 264/111

[51] Int. Cl.[2] ..... B22D 23/08

[58] Field of Search ..... 75/.5 B, .5 BB, .5 C, 75/.5 BA; 264/10, 111

[56] References Cited

UNITED STATES PATENTS

| | | | |
|---|---|---|---|
| 3,211,548 | 10/1965 | Scheller et al. | 75/.5 BB |
| 3,475,158 | 10/1969 | Nevenschwander | 75/.5 BB |
| 3,852,061 | 12/1974 | Wulff | 75/.5 BB |

*Primary Examiner*—W. Stallard
*Attorney, Agent, or Firm*—Norman J. O'Malley; Donald R. Castle; John C. Fox

[57] ABSTRACT

Free flowing powders such as for flame spray applications are produced by agglomerating finely divided material, classifying the agglomerates to obtain a desired size range, entraining the agglomerates in a carrier gas, feeding the agglomerates through a high temperature plasma reactor to cause at least partial melting of the particles, and collecting the particles in a cooling chamber containing a protective gaseous atmosphere, wherein the particles are solidified.

5 Claims, 2 Drawing Figures

PROCESS FOR PRODUCING FREE FLOWING POWDER AND PRODUCT

CROSS REFERENCE TO RELATED APPLICATION

This application is a division of Ser. No. 425,226, now U.S. Pat. No. 3,909,241 filed Dec. 17, 1973 and assigned to the assignee of the present invention, Assignment recorded Dec. 17, 1973, Reel 3036, Frame 784.

BACKGROUND OF THE INVENTION

1. Field of the Invention

This invention relates to an improved process for obtaining free flowing powders, and more particularly relates to a method of forming substantially spherical, dense particles from agglomerates of finely divided particulate material, and also relates to the resultant product.

2. Prior Art

Free flowing powders are useful in a variety of applications in the ceramic and metallurgical arts, such as in the formation of powder compacts, in casting and in coating operations, such as flame spraying.

Metallic and ceramic flame spray coatings are frequently applied to various articles to impart properties such as hardness, wear resistance, good lubricity, corrosion resistance, improved electrical properties or perhaps simply to build up a used part which has worn below usable tolerances.

Powders for flame spraying are desirably uniform in size and composition, and relatively free flowing. Flowability must be sufficient for the powders to be uniformly transported to and injected into the flame. In general, the finer the powders, the poorer the flow characteristics. Although considerable advances have been made in powder feeding equipment, powders less than about 40 micrometers generally do not flow well enough for general use.

The ceramics and powder metallurgy industry have used various agglomeration methods in order to make free flowing powders of normally non-flowing small diameter powder particles, usually involving use of an organic binder to promote formation of the agglomerates. Because of their larger sizes and relatively lower surface area the agglomerates have improved flow properties. Unfortunately, such agglomerated product also has a lower apparent density than the beginning particulate product. This property is the weight of a given volume of uncompacted, loose powder, and is important in flame spraying in that the weight of the coating being deposited depends on the weight of the volume of powder which the flame gum feeder will accept. In addition, the agglomerated product has a larger mean particle size than the beginning material. This is important in that when considering two materials of comparable size ranges, the one having the smaller mean particle size gives a denser, smoother coating. Strength is often improved with denser coatings and smoother coatings require less finishing by grinding or machining.

Flame spray powders having high apparent densities have been made by atomization of molten material. However, atomization processes are characterized by low yields of particles within the desired size range. Furthermore, powders of refractory material are difficult and costly to produce by atomization techniques primarily because of their high melting points.

SUMMARY OF THE INVENTION

The invention is directed towards a method for producing free flowing powders including the steps of entraining these powders in a carrier gas, feeding them through a high temperature reactor at a substantially uniform flow rate so that interparticle contact and coalesence is substantially avoided and at a feed rate such that at least the outer surfaces of a substantial number of particles are melted during their time of exposure to the high temperature zone of the reactor. After passing through the reactor, the particles are then cooled at a rate sufficient to solidify at least the outer surfaces of the particles prior to their contact with a solid surface or with each other.

Because they were melted while entrained in a carrier gas, the solidified particles are substantially spherical, have smooth surfaces and thus have excellent flowability. In addition, the solidified particles have the same general size range as the starting material, but, depending on the porosity of the starting material, may have a smaller mean particle size, due to densification during melting. This densification is advantageous in that it leads to increased efficiency in coating operations.

The free flowing powders of the invention are primarily useful in coating applications, such as flame spray applications, but are also useful in other applications where flowability, apparent density or fine mean particle size are important considerations.

In accordance with a preferred embodiment, materials in finely divided particulate form (less than about 40 micrometers) are agglomerated such as by spray drying in a slurry with a binder, and classified to obtain a desired particle size range. At this stage, the agglomerates are porous, irregular in shape and have a rough surface. They are then processed as above resulting in conversion to smooth, substantially spherical particles, to make powders having apparent densities of 40% of theoretical density or more of the material. If the agglomerates consist of more than one type of particle, of more than one metal or ceramic or a combination thereof, these materials will react or alloy together during melting, to produce prealloyed powders or homogeneous composite particles.

Beneficial chemical reactions may also be carried out during melting. For example, by introducing hydrogen into the hot zone or by mixing carbon into the starting powder material, oxides may be reduced to low levels. Addition of carbon or boron may be used to form carbides or borides.

DETAILED DESCRIPTION OF THE INVENTION

Figure 1:
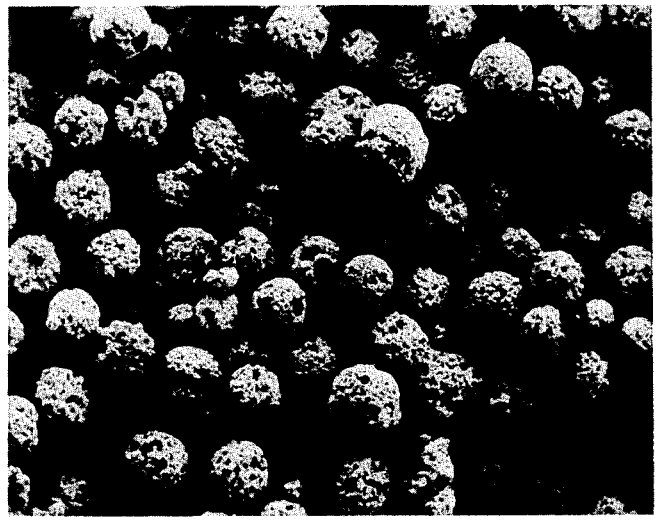
FIG. 1 is a photomicrograph of an agglomerated molybdenum powder produced by spray drying and used as a feed material for the process of the invention.

For a better understanding of the present invention, together with other and further objects, advantages and capabilities thereof, reference is made to the following disclosure and appended claims in connection with the above-described drawings.

The invention may readily be employed with any inorganic material having a melting point above 500°C including elemental metals, alloys, pure or mixed oxides, borides, carbides, nitrides, etc., cermets, or mixed systems of the foregoing. Of particular interest for coating applications are refractory materials having a melting point above 1800°C and including the refractory metals tungsten, molybdenum, chromium, tantalum, and niobium and their alloys and any of the borides, carbides and nitrides with or without any of various modifying additives known or used commercially to enhance one or more properties of these materials. Exemplary of such modified materials are the cemented tungsten carbides containing up to 30 percent cobalt.

Where the beginning particle size of the powder is below about 40 micrometers, the flowability of the powder is in general insufficient to permit readily entraining them in a carrier gas and feeding them through the high temperature reactor. Thus, such particles must normally be agglomerated. Such agglomeration may be by any technique known to the art such as forming powder compacts followed by crushing these compacts or mixing the powder with a binder in the presence of moisture. However, agglomeration by spray drying is in general preferred for its flexibility and economy of operation on a production scale. The particular conditions under which the slurries are formed and spray dried are well known, and are not a necessary part of this description. A detailed description thereof may be found for example in U.S. Pat. No. 3,617,358, issued Nov. 2, 1971.

Depending upon the application envisioned the spray dried agglomerates may be classified, usually by screening, in order to obtain a desired particle size distribution, for example, within a range of about 60 micrometers and preferably 80 percent within a range of 30 micrometers for flame spraying applications.

While practice of the invention only requires a reaction zone temperature above the melting point of the highest melting component of the material being processed, it is preferred to have a temperature at least above the vaporization point of the lowest vaporizing component of the material to enable a relatively short residence time in the reaction zone and consequently to enable processing of large quantities of powders conveniently.

The means for achieving such high temperatures can be any of several commercially available types, but a plasma flame reactor has been found to be convenient due to its temperature capabilities, its atmosphere flexibility, and simplicity. Details of the principles and operation of such plasma flame reactors are well known and thus are not a necessary part of this description. Commercially available plasma flame reactors are equipped with powder feeding means, some of which rely upon gas entrainment, and these have been found satisfactory for the practice of the invention.

Of course it is unnecessary that all particles melt completely, since melting of the outer layer of the particle will result in some degree sphericity, surface smoothness and densification. Furthermore melting of only a certain fraction of the particles will nevertheless result in substantial improvement in flowability of the powder. By way of example, for plasma flame reactors having temperature capabilities between 10,000°F and 30,000°F it has been found that powder feed rate of from ½ up to 30 pounds per hour result in substantial improvement in flowability of the final product. However, for optimum improvement in flowability a powder feed rate of from ½ to 15 pounds per hour in the above temperature range is preferable.

Although unnecessary to the practice of the invention, a narrow size distribution may nevertheless be preferred because under set melting condition particles above a certain size range do not melt completely, and particles below a certain size may be heated to the vaporization temperature.

The melted particles must be cooled at a rate sufficient to solidify at least an outer layer of the particles prior to their contact with a solid surface or with each other, in order to maintain their sphericity and particle integrity. While any of several known techniques may be used to achieve this result, it has been found convenient to feed the at least partially melted particles, while still entrained in the carrier gas, into a liquid cooled chamber containing a gaseous atmosphere, which may be reactive or protective, depending upon the nature of the product desired. The chamber may also conveniently serve as a collection vessel. The size distribution of the starting material is substantially retained in the final product, while the mean particle size may be up to 50 percent smaller, depending upon the porosity of the starting material, due to the densification caused by melting.

Several examples are now presented to illustrate various modes of carrying out the invention.

EXAMPLE I

Molybdenum powder is agglomerated by spray drying an aqueous slurry of 70 without solids molybdenum, 2 without Carbowax 6000 (tradename for a commercially available polyethylene glycol binder) and 0.25 without polyvinyl alcohol. The slurry is fed through one inlet of a two fluid nozzle into a commercially available spray dryer at a rate of 4 gallons per hour (114 pounds of slurry per hour) while heated air is fed into the other inlet. Inlet air temperature is 400°C and outlet air temperature is 165°C.

The spray dried powder is fired for approximately 7 hours at 1000°C to remove the organic binders and to strengthen the agglomerate particles. The fired powder is then separated into size fractions by screening. The size ranges obtained are −100 + 200, −170 + 200, −200 + 325 mesh, and −270 + 325 mesh, Standard U.S. Sieve.

Each size fraction is fed separately through a commercially available plasma torch into a water cooled collection tank. A mixture of 126 cubic feet per hour of argon and 70 cubic feet per hour of hydrogen is fed to the plasma torch. The torch power is about 28 KVA. Nitrogen gas is fed to a powder feeder at a rate of 7 cubic feet per hour to entrain the powder and then is fed through the torch. The nitrogen provides a nonreactive atmosphere as well.

The product collected is then examined. Product size and yield information is shown in Table I.

TABLE I

Induction $A/H_2$ Plasma
Spray Dried Mo

| Feed Size | −100+200 | −170+200 | −200+325 | −270+325 |
|---|---|---|---|---|
| Feed Weight (grams) | 616 | 267 | 980 | 572 |
| Run Time (mins.) | 90 | 40 | 75 | 61 |
| Feed Rate | — | — | — | — |

TABLE I-continued

| (lbs/hr) Torch Power (KVA) | 28.2 | 27.4 | 24.5–26.3 | 28.8 |
|---|---|---|---|---|
| Product | Wt.(grams) Wt. % | | Wt. (grams) Wt. % | |
| +200 | 80 | 16.8 | 2 | 0.8 |
| −200+325 | 333 | 70.1 | 170 | 69.7 |
| −325+400 | 27 | 5.7 | 40 | 16.4 |
| −400 | 35 | 7.4 | 32 | 13.1 |
| TOTAL | 475 | 100 | 244 | 100 |
| +270 | 25 | 2.5 | 3 | 0.6 |
| −270+325 | 442 | 43.4 | 39 | 7.9 |
| −325+400 | 267 | 26.2 | 113 | 23.0 |
| −400 | 285 | 28.0 | 337 | 68.5 |
| TOTAL | 1019 | 100 | 492 | 100 |

Figure 2:
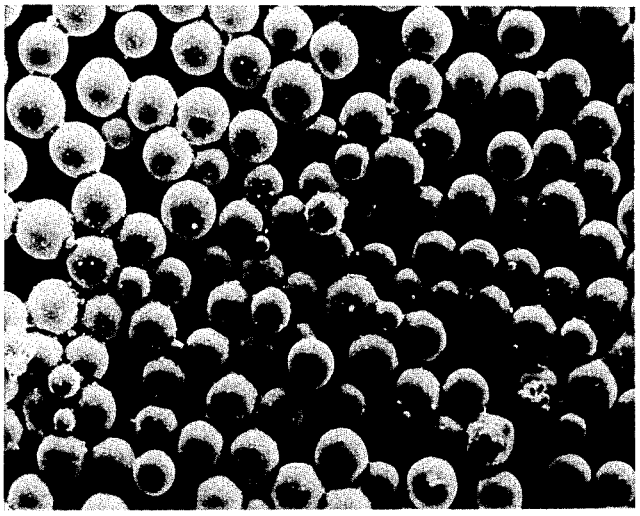
FIG. 2 is a photomicrograph of the feed powder of FIG. 1 after having been fed through a high temperature plasma reactor and cooled in accordance with the invention.

The effect that melting has on densifying the particles is shown by the decrease in particle diameter. The −100+200 mesh feed drops to 83 percent below 200 mesh. The −270+325 mesh feed decreases to 91.5 percent below 325 mesh. Measurements on apparent density show an increase from 1.8 g/cc for the spray dried feed to 5.4 g/cc for the product. Flow by a Hall Flowmeter according to ASTM specification B213-48 in which the time for 50 g to flow through a standard orifice is measured. Flow for the spray dried feed is 41 seconds and for the product is 11–12 seconds. Scanning electron micrographs of the spray dried and final products are shown in FIGS. 1 and 2, respectively, for the −200+325 mesh fraction.

EXAMPLE II

Spray dried, agglomerated molybdenum feed is prepared as indicated in the first example. It is classified by screening and the −200+325 mesh fraction is fed into a commercially available resistance arc plasma gun attached to a collection chamber, at a rate of 1.4 lbs./hr, gun current and voltage settings are 500 amps and 28 volts. Argon is used for the powder feed carrier gas at 0.7 cubic feet per hour and for the plasma gun at 28 cubic feet per hour. The resultant product has an apparent density of 5.3 grams per cubic centimeter and a flow time of 14–16 seconds. Microscopic observation shows a small fraction, about 3 percent, of particles which appear to be unmelted. These are readily removed by air classification. The remaining 97 percent product has an apparent density of 5.6 grams per cubic centimeter and a flow time of 10-seconds. A screen check of the product shows the following distribution of sizes in weight percent:

| | |
|---|---|
| −200+270 | 13.2% |
| −270+325 | 47.3% |
| −325 | 39.4% |

EXAMPLE III

A Mo-34 weight percent Ni powder is prepared by spray drying a slurry of molybdenum powder with a carbonyl source nickel. The powder is spray dried and fired as in Example I, classified and the −200+325 fraction passed through the induction plasma gun. Gun power is about 20 KVA. Nitrogen as the carrier gas is fed at the rate of 7 cubic feet per hour, and argon as the plasma gas at the rate of 126 cubic feet per hour. Spherical, free flowing Mo-34 Ni alloy powder is formed, having an apparent density of 3.44 grams per cubic centimeter and a Hall flow of 21 seconds for the −270+325 product.

EXAMPLE IV

A Mo-15 weight percent W powder is prepared by spray drying molybdenum powder as a slurry with water and binder and fired as in Example I. The spray dried and fired product is classified and fed to the plasma gun. Argon as the carrier gas is fed at the rate of 0.8 cubic feet per hour and as the plasma gas is at 28 cubic feet per hour. Gun current is 550 amps and gun voltage is 28 volts. The product is a Mo-15W alloy powder with an apparent density of 6.22 grams per cubic centimeter and a flow time of 9 seconds for the −325 mesh fraction.

EXAMPLE V

Ni-15 atom percent Mo (Ni-22.4 weight percent Mo) and Ni-15 atom percent W (Ni-35.6 weight percent W) powders are made by slurrying molybdenum and tungsten powders with the appropriate amounts of carbonyl source nickel. The binder is 2% Carbowax 6000 dissolved in water. Instead of spray drying, these powders are agglomerated by drying in trays and then passing the resulting cake through a 20 mesh screen. This powder is then fired at 1100°C for about 1 hour to remove the binder and further classified by screening. The −200+325 mesh fraction is fed to the plasma gun to give dense, free flowing alloy powders.

While there has been shown and described what are at present considered the preferred embodiments of the invention, it will be obvious to those skilled in the art that various changes and modifications may be made therein without departing from the scope of the invention as defined by the appended claims.

What is claimed is:

1. Process for producing a free flowing flame spray powder consisting essentially of substantially spherical particles of an inorganic material having a melting point above 500°C; the particles having an apparent density of at least 40 percent of the theoretical density of the material, a particle size distribution within the range of about 60 micrometers, substantially smooth non-porous surfaces and a Hall flow within the range of from about 9 to 21 seconds; the process comprising:

a. entraining powder particles in a carrier gas, said particles consisting essentially of agglomerates of a finely divided particulate of the inorganic material, the agglomerates having a size range of 60 micrometers and 80 percent of the agglomerates having a size range of 30 micrometers, b. feeding the entrained particles through a high temperature reactor having a temperature above the melting point of the highest melting component of the powder material, at a feed rate sufficient to result in the melting of at least the outer surfaces of a substantial portion of the particles, and c. cooling the at least partially melted particle to solidify at least the outer surfaces of the particles prior to their contact with a solid surface or with each other.

2. Process of claim 1 in which the high temperature reactor is a plasma reactor having a temperature within the range of 10,000°F to 30,000°F and in which the powder feed rate through the reactor is from ½ to 30 pounds per hour.

3. Process of claim 2 in which the powder feed rate is from ½ to 15 pounds per hour.

4. Process of claim 1 in which the inorganic material has a melting point above 1800°C.

5. Process of claim 4 in which the material is selected from the group consisting of molybdenum, tungsten and their alloys.

* * * * *